US008583010B2

(12) United States Patent
Lee et al.

(10) Patent No.: US 8,583,010 B2
(45) Date of Patent: Nov. 12, 2013

(54) IMAGE FORMING APPARATUS EMPLOYING AN ELECTRICAL CHARGE REMOVAL DEVICE WITH AN IMPROVED CONFIGURATION

(71) Applicants: Jun-Ho Lee, Seoul (KR); Jeong-Yong Ju, Hwaseong-si (KR)

(72) Inventors: Jun-Ho Lee, Seoul (KR); Jeong-Yong Ju, Hwaseong-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 0 days.

(21) Appl. No.: 13/761,383

(22) Filed: Feb. 7, 2013

(65) Prior Publication Data

US 2013/0149006 A1 Jun. 13, 2013

Related U.S. Application Data

(63) Continuation of application No. 12/787,931, filed on May 26, 2010, now Pat. No. 8,396,394.

(30) Foreign Application Priority Data

Sep. 21, 2009 (KR) ..... 10-2009-0089259

(51) Int. Cl.
*G03G 15/16* (2006.01)

(52) U.S. Cl.
USPC ..... 399/121; 399/315

(58) Field of Classification Search
USPC ..... 399/121, 315
See application file for complete search history.

(56) References Cited

U.S. PATENT DOCUMENTS

| | | | | |
|---|---|---|---|---|
| 5,345,295 | A | 9/1994 | Takano et al. | |
| 7,251,443 | B2 | 7/2007 | Koike et al. | |
| 7,599,652 | B2 | 10/2009 | Takagami | |
| 8,396,394 | B2 * | 3/2013 | Lee et al. | 399/121 |

OTHER PUBLICATIONS

United States *Ex-Parte Quayle* Office Action dated Aug. 24, 2012 issued in U.S. Appl. No. 12/787,931.
United States Notice of Allowance dated Nov. 14, 2012 issued in U.S. Appl. No. 12/787,931.

* cited by examiner

*Primary Examiner* — William J Royer
(74) *Attorney, Agent, or Firm* — Stanzione & Kim, LLP

(57) ABSTRACT

An image forming apparatus, including: a main body; an image carrying body disposed in the main body, a transfer unit and an electrical charge removal unit. The image forming apparatus forms a visible image on the image carrying body by carrying out charging, exposing and developing processes. The transfer unit transfers the visible image from the image carrying body to a printing medium. The electrical charge removal unit is configured to remove the residual electrical charge from the printing medium, and is movable, in cooperation with at least one replaceable component part of the transfer unit, between an operable position at which the electrical charge removal unit is capable of removing the electrical charge from the printing medium and a non-interfering position at which the electrical charge removal unit does not interfere with the movement of the at least one replaceable component part of the transfer unit being received into or being removed from the main body for replacement.

11 Claims, 11 Drawing Sheets

IMAGE FORMING APPARATUS EMPLOYING AN ELECTRICAL CHARGE REMOVAL DEVICE WITH AN IMPROVED CONFIGURATION

CROSS-REFERENCE TO RELATED APPLICATIONS

This application is a Continuation application of prior application Ser. No. 12/787,931, filed on May 26, 2010 in the United States Patent and Trademark Office, which claims priority from Korean Patent Application No. 10-2009-0089259, filed on Sep. 21, 2009 in the Korean Intellectual Property Office, the disclosure of which is incorporated herein by reference.

BACKGROUND OF THE INVENTION

1. Field of the Invention

The present disclosure relates generally to an image forming apparatus, and more particularly, to an image forming apparatus employing a device for removing electrical charge from a print medium with an improved configuration that affords a more convenient replacement of the component(s) of the image forming apparatus.

2. Description of the Related Art

Generally speaking, an image forming apparatus of an electrophotographic type forms an image on a printing medium through charging, exposing, developing, transferring and fusing processes. For example, FIG. 1 illustrates the relevant portions of a conventional electrophotographic type color image forming apparatus of a so-called tandem type, which may typically include a plurality of image carrying bodies 10 on which visible images are formed with developer (not shown) of different colors, a transferring unit 20 operable to transfer the visible images respectively formed on the image carrying bodies 10 to a printing medium M and a fusing unit 30 fusing the transferred image onto the printing medium M by applying heat and pressure.

In an image forming apparatus of the configuration shown in FIG. 1, the transferring unit 20 includes a plurality of transferring rollers 21 facing respectively the image carrying bodies 10 and a transferring belt 25 arranged to pass between the image carrying bodies 10 and the transferring rollers 21 while transporting thereon the printing medium M. A transfer voltage of a polarity opposite to that of the voltage being applied to the image carrying bodies 10 may be applied to the transferring rollers 21, to thereby cause the toner particles on the image carrying bodies 10 to be transferred to the printing medium M.

Such transfer voltage is to some extent also applied to the printing medium M so that, when the printing medium M passes through the transfer nip formed between an image carrying body 10 and a transferring roller 21, a gap electric discharge (or sometime also referred to as the printing medium division electric discharge) occurs due to the resulting electric potential difference between the image carrying body 10 and the printing medium M at the region in the vicinity of the transferring nip, particularly in the region immediately upstream or downstream of the transferring nip as indicated by the area A in FIG. 1. Such gap electric discharges can lead to an image scattering.

To address the above described image scattering by the gap electric discharge, as, for example, illustrated in FIG. 2, an electrical charge removal device 40 may be employed. The electrical charge removal device 40 includes a bracket 41 for mounting the electrical charge removal device 40 to a main body frame of an image forming apparatus and a needle shape electrode 45 supported on the bracket 41. The needle shape electrode 45 removes electrical charges from a printing medium to reduce an electric potential difference between an image carrying body 10 and the printing medium, thereby reducing the likelihood of occurrences of gap electric discharges.

When such an electrical charge removal device 40 is employed, the positioning of the electrical charge removal device 40 in relation to a transferring roller 21 and the distance between an end of the needle shape electrode 45 and the printing medium influence the charge removal performance. That is, the proper positioning of the electrical charge removal device 40 may be needed for the optimum performance that sufficiently reduces the occurrences of the gap electric discharges. For example, an improved performance may be realized by positioning the end of the needle shape electrode 45 close to the transfer nip, preferably in a space B, i.e., inside the diameter of the transferring roller 21.

As the transferring unit 20 including the transferring roller 21, to which the transfer voltage is applied, ordinarily has a shorter useful operational life than the useful life of the image forming apparatus as a whole, the transferring unit 20 is typically provided to be replaceable. From the cost effectiveness standpoint, it is more advantageous to be able to replace only the transferring roller 21 along with its supporting holder (not shown) rather than having to replace the entire transferring unit 20. To provide the transferring roller 21 in such an arrangement that it presses against the image carrying body 10 in order to form the transfer nip when operably mounted in the image forming apparatus, it may be necessary for the transferring roller 21 to be removed for replacement along the direction of the image carrying body 10 (i.e., the direction indicated by the arrow C in FIG. 2) along which the pressing force is to be applied.

However, unfortunately, the removal of the transferring roller 21 along such direction of the image carrying body 10 is interfered by the needle shape needle shape electrode 45 if the needle shape electrode 45 is placed in the space B for the optimal charge removal performance. It is therefore difficult to arrange the needle shape electrode 45 optimally in the space B without having to remove and replace the needle shape electrode 45 together with the transferring roller 21 even if the replacement of the electrode itself may be unnecessary.

SUMMARY OF THE INVENTION

According to an aspect of the present disclosure, there may be provided an image forming apparatus that may include a main body, an image carrying body, a transfer unit and an electrical charge removal unit. The image carrying body may be disposed in the main body, and may be configured to support thereon a visible image formed of developer. The transfer unit may be detachably received in the main body, and may be configured to receive the visible image from the image carrying body and to convey the received visible image to a printing medium. The electrical charge removal unit may be movably supported in the main body, and may be configured to remove an electrical charge from the printing medium. The electrical charge removal unit may further be configured to move in cooperation with at least a portion of the transfer unit in such a manner the electrical charge removal unit moves in association with at least one of mounting and detaching movements of the at least a portion of the transfer unit between a first position at which the electrical charge removal unit is operable to remove the electrical charge from the printing medium and a second position at which the electrical charge removal unit does not interfere with the at least one of mounting and detaching movements of the at least a portion of the transfer unit.

The electrical charge removal unit may be configured to move to the second position from the first position before a completion of mounting or detaching of the at least a portion of the transfer unit so as not to interfere with the at least one of mounting and detaching movements of the at least a portion of the transfer unit.

The transfer unit may comprise an intermediate transfer unit, a transfer roller and a transfer roller holder. The intermediate transfer unit may be configured to receive the visible image from the image carrying body. The transfer roller may be arranged to form a transfer nip with the intermediate transfer unit, and may be configured to cause the visible image to be transferred from the intermediate transfer unit to the printing medium passing through the transfer nip. The transfer roller holder may be rotatably supporting thereon the transfer roller, and may be receivable into the main body in a first direction forming the transfer nip between the transfer roller and the intermediate transfer unit, and being detachable from the main body in a second direction opposite the first direction. The at least a portion of the transfer unit may comprise the transfer roller and the transfer roller holder.

The intermediate transfer unit may comprise one or more intermediate transfer backup rollers, a transfer belt, a driving roller and a transfer backup roller. The one or more intermediate transfer backup rollers may each be rotatably supported in the main body. The transfer belt may be rotatable to pass between the image carrying body and the one or more intermediate transfer backup rollers to thereby receive the visible image from the image carrying body. The driving roller may be configured to drive the transfer belt to rotate. The transfer backup roller may be arranged to opposingly face the transfer roller with the transfer belt interposed therebetween.

The transfer unit may alternatively comprise a transfer roller and a transfer roller holder. The transfer roller may be arranged to form a transferring nip through which the printing medium passes to receive the visible image from the transfer unit. The transfer roller holder may rotatably support thereon the transfer roller, may be receivable into the main body in a first direction forming the transfer nip, and may be detachable from the main body in a second direction opposite the first direction.

The transfer unit may further comprise an elastic member arranged between the main body and the transfer roller holder in such a manner elastically biasing the transfer roller in the first direction.

The electrical charge removal unit may comprise an electrode holder, an electrode and an electrode support elastic member. The electrode holder may be rotatably supported on the main body. The electrode may be supported on the electrode holder, and may be configured and arranged to remove the electric charge from the printing medium after the visible image is at least partially transferred on the printing medium. The electrode support elastic member may be disposed between the main body and the electrode holder so as to elastically bias the electrode holder in a direction of moving the electrical charge removal unit to the first position.

An end portion of the electrode may be positioned within a path of mounting or detaching movement of the transfer roller when the electrical charge removal unit is in the first position.

The image forming apparatus may further comprise first and second guide members respectively formed on the transfer roller holder and the electrode holder. The first and second guide members may be in an interfering contact with each other during mounting or detaching of the transfer roller to guide the electrode to selectively move into and out of the path of mounting or detaching movement of the transfer roller.

The first guide member may comprise a guide protrusion protruding from the transfer roller holder so as to make an interfering contact with the second guide member when the transfer roller holder is received into or detached from the main body.

The second guide member may comprise a first guide surface that may be configured to guide the rotation of the electrode holder in such a manner to cause the electrode to move from the first position to the second position when the transfer roller holder is received into the main body and a second guide surface that may be configured to guide the rotation of the electrode holder to move from the first position to the second position when the transfer roller holder is detached from the main body.

According to another aspect of the present disclosure, an image forming apparatus may be provided for developing a developer image on an image carrying body and for transferring the developer image from the image carrying body to a printing medium transported on a printing medium transport path in a main body of the image forming apparatus in which the image carrying body is housed. The image forming apparatus may comprise a component receiving path defined in the main body along which a replaceable component of the image forming apparatus is received into or removed from the main body and a charge removal device. The charge removal device may have an electrode configured to remove electrical charge from the printing medium, and may be configured to move, in association with a movement of the replaceable component along the component receiving path, between a first position at which at least a portion of the electrode is within the component receiving path so as to interfere with the movement of the replaceable component along the component receiving path and a second position at which the electrode does not interfere with the movement of the replaceable component within the component receiving path.

The image forming apparatus may further comprise a transfer unit that may be configured to transfer the developer image from the image carrying body to the printing medium. The charge removal device may be arranged along the printing media transport path downstream of the transfer unit with respect to a transport direction of the printing medium.

The replaceable component may comprise a transfer roller opposingly facing, and thereby forming a transfer nip with, the image carrying body. The printing medium may be transported through the transfer nip, and may receive the developer image from the image carrying body at the transfer nip The replaceable component may alternatively comprise a transfer roller opposingly facing, and thereby forming a transfer nip with, an intermediate transfer belt that receives the developer image from the image carrying body. The printing medium may be transported through the transfer nip, and may receive the developer image from the intermediate transfer belt at the transfer nip.

The charge removal device may comprises an electrode holder that may be pivotably coupled to the main body and supporting thereon the electrode The charge removal device may further comprise an elastic member coupled to the electrode holder in such a manner to elastically bias the charge removal device toward the first position.

The electrode holder may comprise first and second inclined guide surfaces that are not parallel to each other. The first inclined guide surface may be in pressing contact with the replaceable component that is being received into the main body so as to allow the charge removal device to overcome an elastic force of the elastic member and to thereby move to the second position. The second inclined guide surface may be in pressing contact with the replaceable component that is being removed from the main body so as to allow the charge removal device to overcome the elastic force of the elastic member and to thereby move to the second position.

When the charge removal device is in the first position, a portion of the electrode may be located within a space defined between the transfer nip and an outer circumferential surface of the transfer roller.

BRIEF DESCRIPTION OF THE DRAWINGS

Various features and advantages of the disclosure will become more apparent by the following detailed description of several embodiments thereof with reference to the attached drawings, of which.

DETAILED DESCRIPTION OF THE PREFERRED EMBODIMENTS

Figure 1:
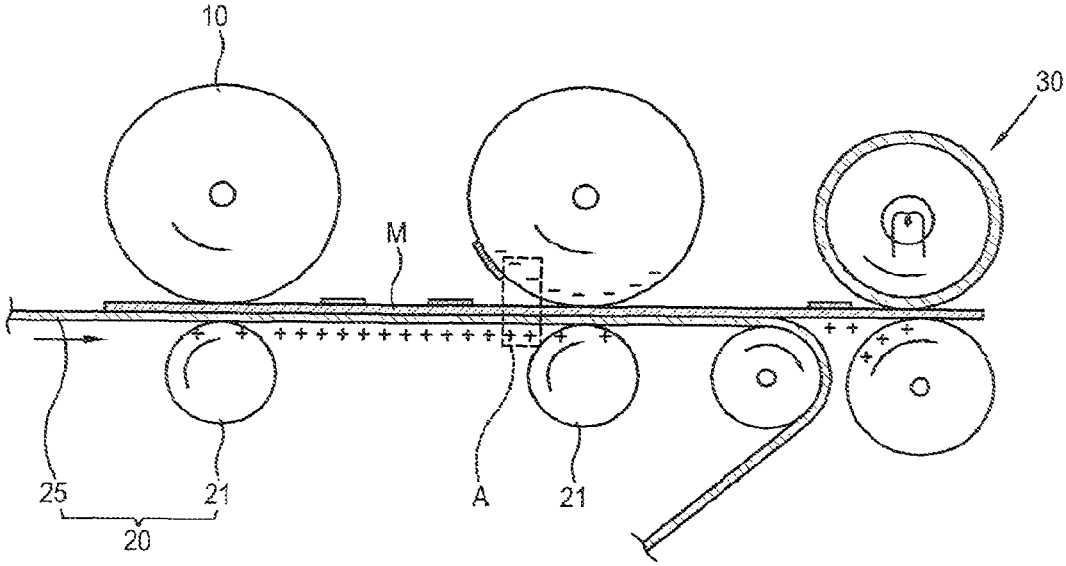
(RELATED ART) FIG. 1
FIG. 1 schematically illustrates the relevant portions of a conventional tandem type image forming apparatus.
Figure 2:
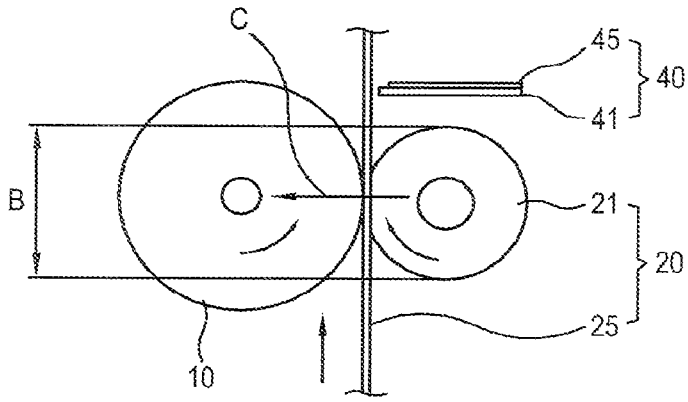
(RELATED ART) FIG. 2
FIG. 2 illustrates a conventional electrical potential removal device employed in the conventional image forming apparatus.

Reference will now be made in detail to several embodiments of the present invention, examples of which are illustrated in the accompanying drawings, wherein like reference numerals refer to like elements. While the embodiments are described with detailed construction and elements to assist in a comprehensive understanding of the various applications and advantages of the embodiments, it should be apparent however that the embodiments can be carried out without those specifically detailed particulars. Also, well-known functions or constructions will not be described in detail so as to avoid obscuring the description with unnecessary detail. It should be also noted that in the drawings, the dimensions of the features are not intended to be to true scale and may be exaggerated for the sake of allowing greater understanding.

Figure 3:
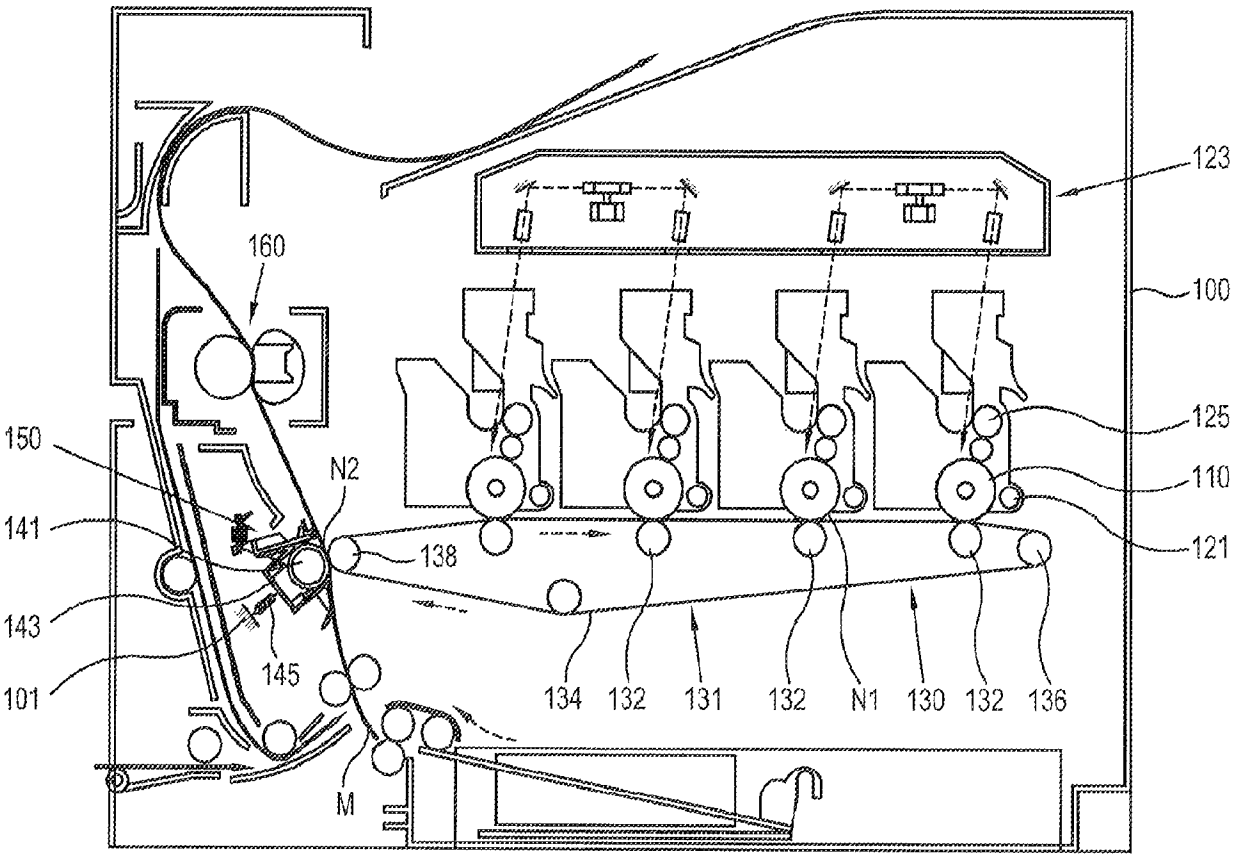
FIG. 3 is a schematic view illustrating an image forming apparatus according to an embodiment of the present disclosure.

Referring to FIG. 3, an image forming apparatus according to an embodiment of the present disclosure may be an electrophotographic type image forming apparatus, which, in the particular example illustrated, is of a tandem type, in which images of several different colors are transferred onto a printing medium on a single pass, and may include a main body 100, one or more image carrying bodies 110, for example, corresponding respectively to the several colors of developer, arranged in tandem along a printing path. The image forming apparatus may further include a transfer unit 130 configured to transfer the visible images of respective developer colors from the image carrying bodies 110 to a printing medium M and an electrical charge removal unit 150 arranged to remove residual electrical charge remaining on the printing medium M after the transfer of the images thereto. The image carrying bodies 110 may be disposed to a support frame in the main body 100, and may each support on the outer surface thereof a visible image that is formed by the charging, exposing and developing processes. To that end, the image forming apparatus may include one or more charging units 121 each configured to charge the corresponding image carrying body 110 to a predetermined electrical potential, an exposing unit 123 configured to render a latent image on each image carrying body 110 by exposing the charged surface thereof with light and one or more developing units 125 each configured to develop the latent image with developer into a visible image on the corresponding image carrying body 110. The image forming apparatus may further include a fusing unit 160 for applying heat and pressure to thereby fix the visible image onto the printing medium M.

The exposing unit 123 exposes an image carrying body 110, which had been charged to a uniform potential by the charging unit 121, to thereby form a latent image of the resulting potential differences, and may include a light scanning unit (LSU) scanning a light corresponding to the intended image to be formed on a printing medium M.

The developing unit 125 may each supply developer of respective one of the different colors to the corresponding image carrying body 110 to develop the latent image thereof into a visible developer image.

The transfer unit 130 may transfer the visible images from the image carrying bodies 110 onto the printing medium M supplied along a printing medium transport path.

The transfer unit 130 according to an embodiment may include an intermediate transfer unit 131 that receives the visible images developed on the image carrying bodies 110, a transfer roller 141 arranged to face the intermediate transfer unit 131 and a transfer roller holder 143 rotatably supporting the transfer roller 141. The transfer roller holder 143 may in turn be supported on a support frame 101 of the main body 100, and may be elastically biased by a transfer roller support elastic member 145, which will be described later in greater detail.

The intermediate transfer unit 131 may include a plurality of intermediate transfer backup rollers 132 arranged to opposingly face the respective corresponding ones of the plurality of image carrying bodies 110, a transfer belt 134, a driving roller 136 driving the transfer belt 134 to rotate and a transfer backup roller 138. The intermediate transfer backup rollers' 132 may be rotatably supported in the main body 100, and may form a first transfer nip N1 with the image carrying body 110. The transfer belt 134 may travel between the image carrying bodies 110 and the intermediate transfer backup rollers 132, and may receive the developed visible images from the image carrying bodies 110. The driving roller 136 may be rotatably supported in the main body 100, and may drive the transfer belt 134 to rotate. The intermediate transfer backup rollers 132 may support the transfer belt 134, and may be arranged in the main body 100 to opposingly face the respective ones of the image carrying bodies 110 with the transfer belt 134 interposed therebetween so that the first transfer nip N1 can be formed between the transfer belt 134 and an image carrying body 110.

The transfer roller 141 forms a second transfer nip N2 with the transfer belt 134, and may transfer the image that had been transferred to the transfer belt 134 from the transfer belt 134 to the printing medium M. The transfer roller holder 143 may be provided at the opposite ends of the transfer roller 141 to rotatably support the transfer roller 141, and may be supported on the main body 100. The transfer roller holder 143 may be detachably received in the main body 100, and may thus allow the removal of the transfer roller holder 143 for replacement as a replaceable sub assembly unit. The direction along which the transfer roller 141 and the transfer roller holder 143 are mounted and detached is the direction of forming the second transfer nip N2, that is, parallel to a line connecting the respective centers of the second transfer nip N2 and the transfer roller 141. By mounting and detaching the transfer roller 141 and the transfer roller holder 143 in the pressing direction of the transfer roller 141, the second transfer nip N2 formed between the transfer roller 141 and the transfer belt 134 by the pressing force between the transfer roller 141 and the transfer backup roller 138 can be more stable.

Figure 4:
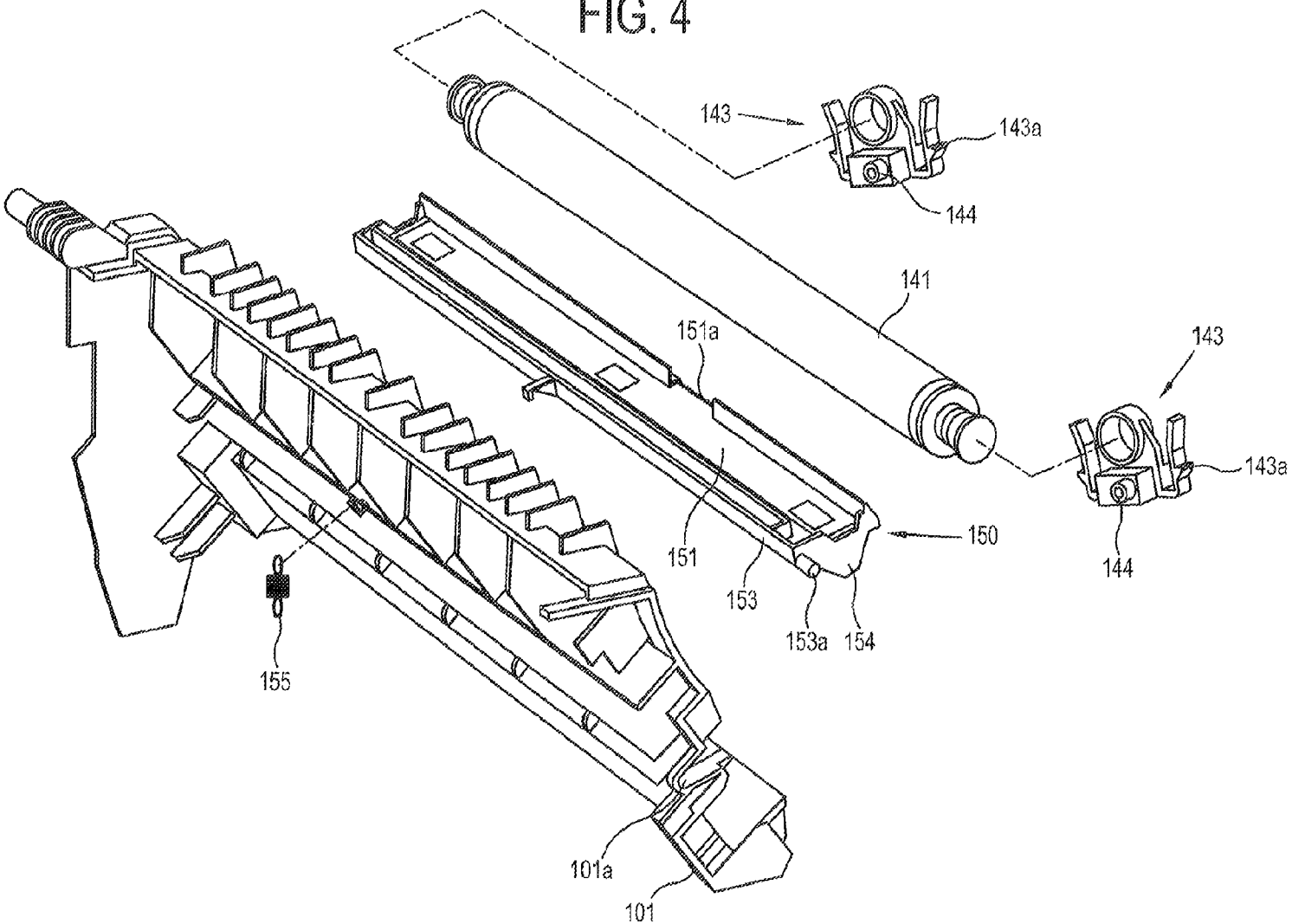
FIG. 4 is an exploded perspective view illustrating relevant portions of an image forming apparatus according to an embodiment of the present disclosure.
Figure 5:
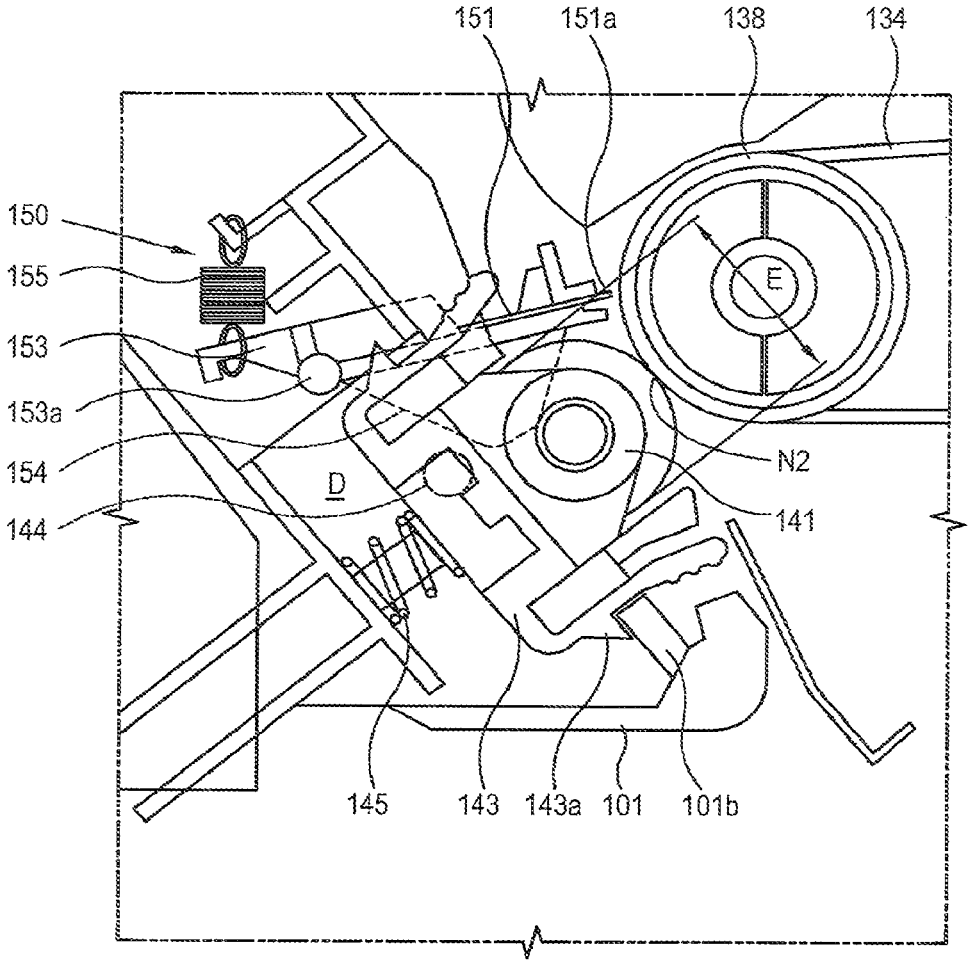
FIG. 5 is a schematic side view illustrating portions of the image forming apparatus according to an embodiment of the present disclosure.

As shown in FIGS. 4 and 5, the transfer roller holder 143 may be coupled to the support frame 101 of the main body 100 with a hook type engagement. For example, an engagement stopper 101*b* may be formed at a predetermined position of the support frame 101 whereas a hook member 143*a* may be formed on the transfer roller holder 143. The hook member 143*a* may be configured so as to be elastically biased toward the engagement stopper 101*b*, and may be configured to be in an engagement with the engagement stopper 101*b* so as to interfere with the movement of the transfer roller holder 143 along the direction in which the transfer roller holder 143 is detached from the support frame 101.

As the transfer roller holder 143 is placed into the main body 100 to be supported on the support frame 101, due to the contact between the hook member 143*a* and the engagement stopper 101*b* causes the hook member 143*a* to be elastically deformed, allowing the transfer roller holder 143 to move into the proper operable position D. When the transfer roller holder 143 reaches the proper position D, the hook member 143*a* returns to the pre-deformation shape to engage the engagement stopper 101*b*, preventing the transfer roller holder 143 from moving away, and thus separating, from the support frame 101. With the hook member 143*a* engaged with the engagement stopper 101*b*, the transfer roller holder 143 remains in the position D until such engagement is released by deforming the hook member 143*a*.

The transfer unit 130 may further include a transfer roller support elastic member 145 that elastically bias the transfer roller 141 toward the transfer belt 134. The transfer roller support elastic member 145 may be disposed between the support frame 101 and the transfer roller holder 143 to elastically bias the transfer roller 141 so that the transfer roller 141 presses against the transfer belt 134 to form therewith the second transfer nip N2. As illustrated in FIG. 5, the transfer roller support elastic member 145 may be a compression spring. However, various other elastic force providing members such as, for example, a torsion spring, a tension spring, or the like, capable of elastically biasing the transfer roller 141 toward the direction of forming the second transfer nip N2 may be employed as the transfer roller support elastic member 145.

Referring to FIGS. 3 to 7, the electrical charge removal unit 150 according to an embodiment may be arranged so as to remove the electrical charge remaining residual on the printing medium M at the location downstream of the transfer roller 141 along the transport path of the printing medium M, and may be movably supported on the support frame 101 of the main body 100. According to an embodiment, the electrical charge removal unit 150 may be arranged to move in cooperation with the mounting and detaching movements of the transfer roller 141 so as to move between the charge removing position (e.g., the position as shown in FIG. 6D) capable of removing the residual electrical charge from the printing medium M and the non-interfering position (e.g., the position as shown in FIG. 6C) at which position the electrical charge removal unit 150 does not interfere with the mounting and/or the detaching of the transfer roller 141. The electrical charge removal unit 150 may be moved to the non-interfering position from the charge removing position prior to the detaching of the to be replaced transfer roller 141 and/or prior to the mounting of the replacement transfer roller 141 so as to allow the replacement of the transfer roller 141.

To that end, the electrical charge removal unit 150 according to an embodiment may include an electrode 151, an electrode holder 153 and an electrode support elastic member 155. The electrode holder 153 may be rotatably supported on the support frame 101 of the main body 100.

Referring to FIG. 4, the electrode holder 153 may include a hinge unit 153*a* that serves as the rotation center of the electrode holder 153. The hinge unit 153*a* may be rotatably received in a mounting groove 101*a* formed in the support frame 101. The electrode 151 may be supported in the electrode holder 153, and may be arranged so that an end portion 151*a* thereof is capable of being positioned in the vicinity of the second transfer nip N2 to remove the electrical charge remaining on the printing medium M after transferring of the image onto the printing medium M. According to an embodiment, the end portion 151*a* of the electrode 151 positioned toward the printing medium M may have, for example, a saw tooth shape arranged to remove the electrical charge resulting from the gap electric discharge. The electrode 151 may be grounded to the main body 100, or may be applied with a direct current (DC) voltage and/or an alternating current (AC) voltage.

Figure 6A:
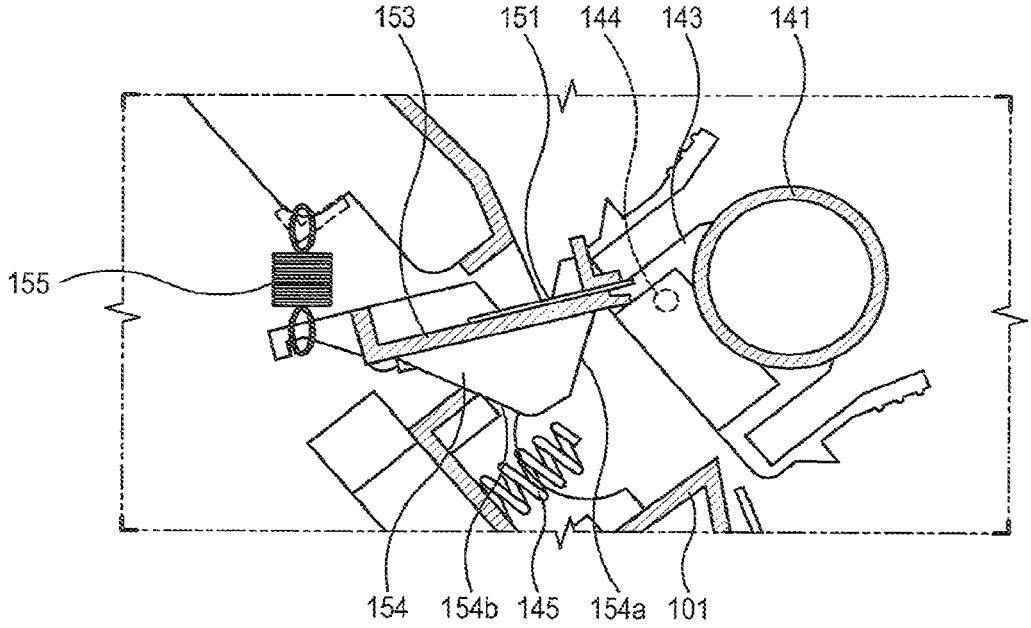
FIGS. 6A to 6D illustrate positional changes of a potential removal unit corresponding to various mounting states of a transfer roller in an image forming apparatus according to an embodiment of the present disclosure.
Figure 6B:
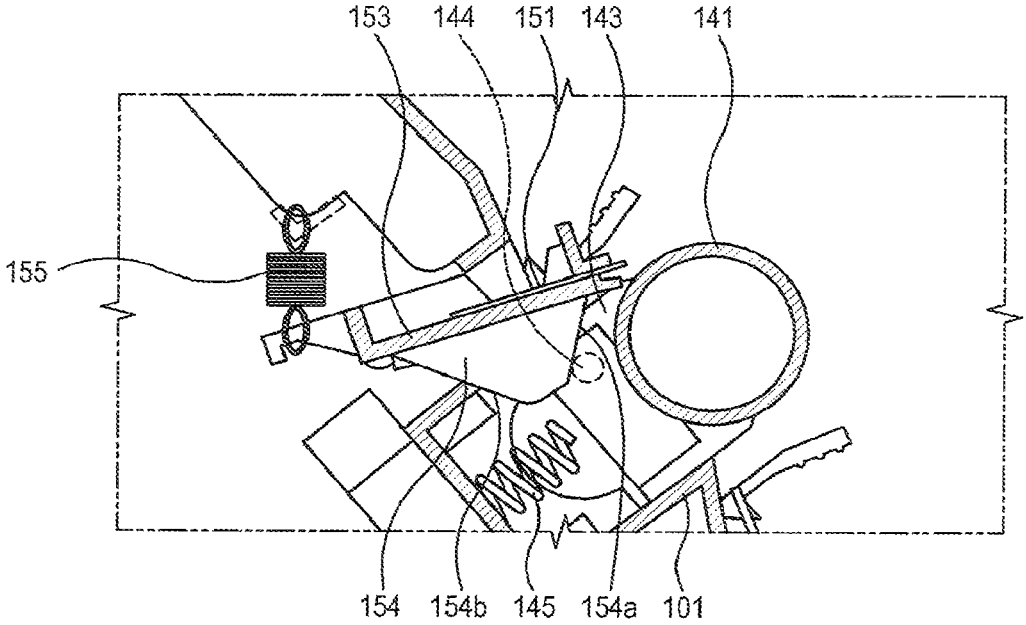
Figure 6C:
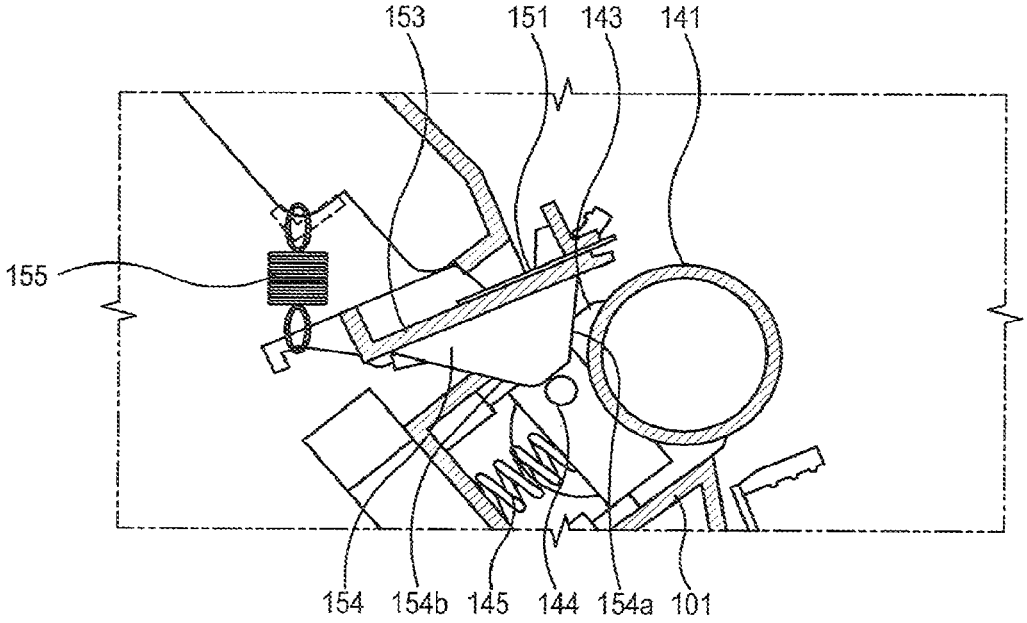
Figure 6D:
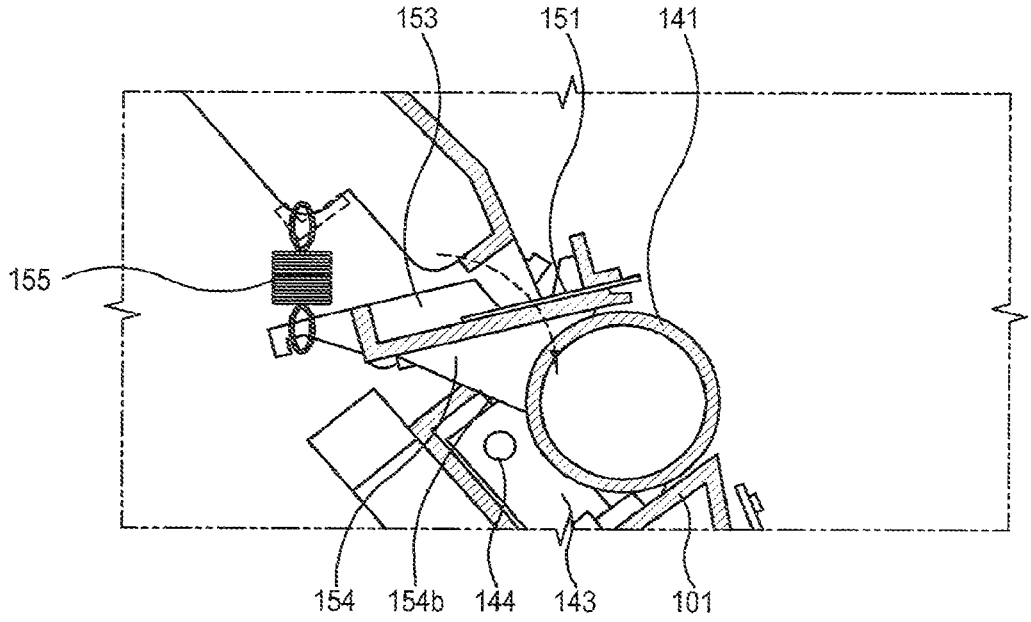

The electrode support elastic member 155 may be disposed between the support frame 101 of the main body 100 and the electrode holder 153 in such manner elastically biasing the electrode 151 toward the charge removing position as shown in FIGS. 6A and 6D. The electrode support elastic member 155 may be a tension spring, as shown in FIG. 4, or any other elastic force providing member such as, for example, a torsion spring, a compression spring, or the like, that is capable of elastically biasing the electrode 151 toward the second transfer nip N2.

Accordingly, absent the application of an external force overcoming the elastic bias of the electrode support elastic member 155, the electrical charge removal unit 150 is allowed to remain in the charge removal position.

Although not required, it may be preferable that when the electrode 151 is in the charge removal position, the end portion 151*a* thereof is positioned within the projecting space E as shown in FIG. 5, which space representing the projection of the transfer roller 141 in the direction toward the second transfer nip N2, in view of the fact that a good charge removal performance can be realized if the electrode 151 is positioned adjacent the transferring region (e.g., in the vicinity of the second transfer nip N2), in which the toner image is transferred by the application of an electrical potential difference.

According to an aspect of the present disclosure, as it would be difficult to replace the transfer roller 141 if the electrode 151 is positioned stationary in the projecting space E of the transfer roller 141, the electrode holder 153 may be configured to move in association with the movement of the transfer roller holder 143 in such a manner the electrode holder 153 moves into the non-interfering position, for example as shown in FIG. 6C, at which position the electrode 151 is outside the projecting space E of the transfer roller 141 so as not to interfere with the replacement of the transfer roller 141.

For example, according to an embodiment, first and second guide members 144 and 154 may be provided respectively in the transfer roller holder 143 and the electrode holder 153 in such an arrangement capable of coming into an interfering contact with each other during the mounting and/or detaching movements of the transfer roller 141 so as to thereby guide the movement of the electrode 151.

The first guide member 144 may include a guide protrusion protruding from the transfer roller holder 143 to be interfered with the second guide member 154 provided on the electrode holder 153 when the transfer roller holder 143 is mounted onto or detached from the support frame 101 of the main body 100.

According to an embodiment, the second guide member 154 may include first and second guide surfaces 154*a* and 154*b*. The first guide surface 154*a* may come into contact with the guide protrusion during the mounting of the transfer roller holder 143 into the main body 100 so as to guide the rotation of the electrode holder 153 in such a manner to cause the electrode 151 to move from the charge removal position to the non-interfering position.

That is, as shown in FIG. 6A, when the transfer roller holder 143 is detached from the main body 100, the second guide member 154 is not in contact with the first guide member 144, allowing the end portion 151*a* of the electrode 151 to be positioned in the projecting space E of the transfer roller 141 by the elastic bias of the electrode support elastic member 155.

As shown in FIG. 6B, as the transfer roller holder 143 is received further toward the support frame 101 to be mounted into the main body 100, before the transfer roller 141 comes into contact with the electrode 151 or with the electrode holder 153, the first guide member 144 makes contact with the first guide surface 154*a* of the second guide member 154. As the first guide member 144 moves further downwardly in pressing contact with the first guide surface 154*a*, as the first guide surface 154*a* is inclined with respect to the moving direction of the guide protrusion, the mounting force of the transfer roller holder 143 overcomes the elastic bias of the electrode support elastic member 155, allowing the electrode holder 153 to rotate counterclockwise about the hinge unit 153*a* so that the end portion 151*a* of the electrode 151 and/or the portions of the electrode holder 153 to move away and out of the projecting space E of the transfer roller 141, that is, out of the mounting path of the transfer roller 141. FIG. 6C illustrates the first guide member 144 being positioned in the intermediary portion between the first guide surface 154*a* and the second guide surface 154b causing the electrode holder 153 to be rotated fully away from the mounting path of the transfer roller 141 to thereby place the electrical charge removal unit 150 in the non-interfering position.

Then, when the transfer roller 141 reaches the intended mounting position, the contact between the first guide member 144 and the second guide member 154 is released, allowing the electrode holder 153 to rotate due to the elastic bias of the electrode support elastic member 155 to thereby return the electrical charge removal unit 150 to the charge removal position The second guide surface 154*b* of the second guide member 154 may guide the rotation of the electrode holder 153 during the detachment of the transfer roller holder 143 from the main body 100 so that the electrical charge removal unit 150 is allowed to move from the charge removal position to the non-interfering position.

Figure 7:
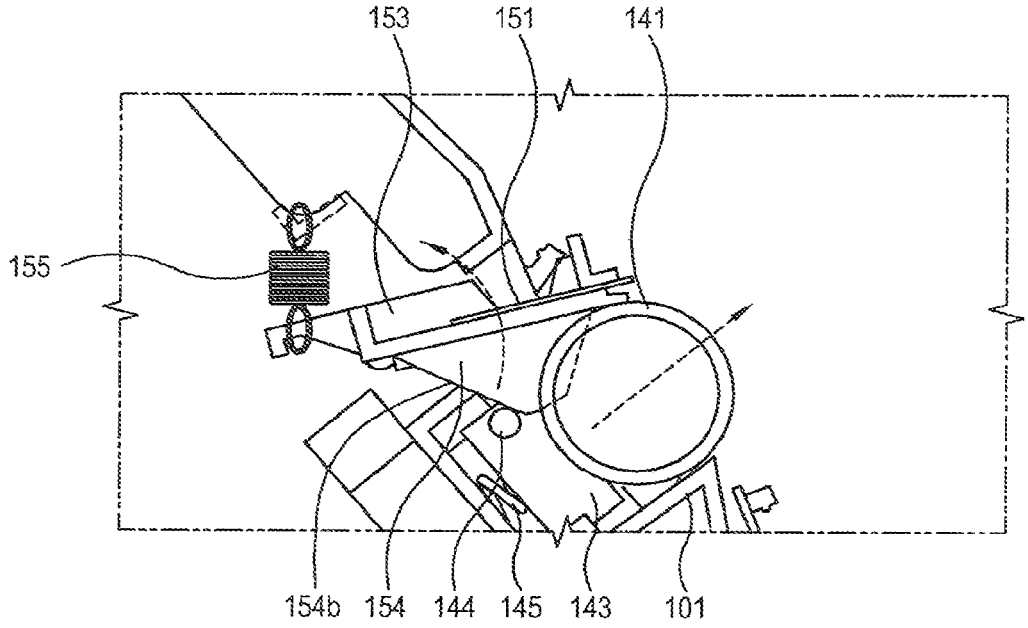
FIG. 7 illustrates the change in the position of the potential removal unit during the detachment of the transfer roller from the image forming apparatus according to an embodiment of the present disclosure.

That is, when the transfer roller 141 is being removed from the main body 100 for replacement, for maintenance, or the like, as shown in FIG. 7, before the transfer roller 141 reaches the end portion 151*a* of the e-electrode 151 or a portion of the electrode holder 153, the first guide member 144 contacts the second guide surface 154*b* of the second guide member 154. As the first guide member 144 moves further upwardly in pressing contact with the first guide surface 154*a* that is inclined with respect to the moving direction of the guide protrusion, the electrode holder 153 rotates counterclockwise about the hinge unit 153*a*, overcoming the elastic bias of the electrode support elastic member 155, so that the end portion 151*a* of the electrode 151 and/or the portions of the electrode holder 153 to move away from and out of the projecting space E of the transfer roller 141. As shown in FIG. 6C, when the first guide member 144 reaches the intermediary portion between the first and second guide surfaces 154*a* and 154*b*, the electrical charge removal unit 150 is positioned in the non-interfering position, allowing the transfer roller 141 to be detached from the main body 100 without being interfered. When the transfer roller 141 is sufficiently detached from the main body 100, as shown in FIG. 6A, the contact between the first guide member 144 and the second guide member 154 is released, allowing the electrode holder 153 to rotate due to the elastic bias of the electrode support elastic member 155 to thereby return the electrical charge removal unit 150 to the charge removal position.

An image forming apparatus according to one or more aspects of the present disclosure as described above may be capable of the placement of a charge removal electrode for an optimal charge removal performance and for convenient replacement of one or more components of the transfer unit, for example, a transfer roller. The charge removal electrode may be arranged to move in association with the mounting/detaching movement of the component being replaced to move in and out of the mounting/detaching path of such component(s) so as not to interfere with the replacement of such component(s).

Figure 8:
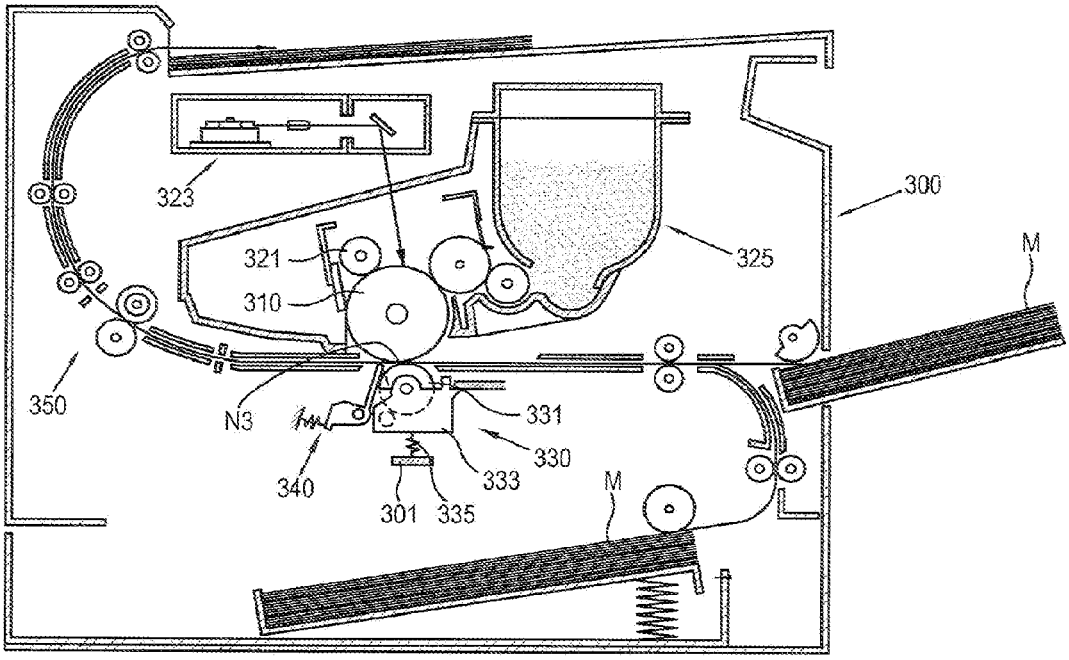
FIG. 8 schematically illustrates an image forming apparatus according to another embodiment of the present disclosure.

As shown in FIG. 8, an image forming apparatus according to another embodiment of the present disclosure may include a main body 300, an image carrying body 310, a transfer unit 330 configured to transfer a visible image developed on the image carrying body 310 to a printing medium M, and an electrical charge removal unit 340 for removing the electric charge from the printing medium M after the transfer of the image to the printing medium M. The image carrying body 310 may be supported in the main body 300, on the outer surface of which may be formed a visible image by charging, exposing and developing processes. To that end, the image forming apparatus may include a charging unit 321 for charging the image carrying body 310 to a predetermined electrical potential, an exposing unit 323 for forming a latent image on the image carrying body 310 and a developing unit 325 for developing the latent image on the image carrying body 310 into a visible image. The image forming apparatus may further include a fusing unit 350 for fusing the image transferred to the printing medium M on the printing medium M.

In comparison to the image forming apparatus according to the previously described embodiments of the present disclosure, the image forming apparatus according to an embodiment illustrated in FIG. 8 does not employ an intermediate transfer belt in transferring the images from the image carrying body or bodies to the printing medium M, and is instead configured to transfer the images from the image carrying bodies to the printing medium M. According to an embodiment, the image forming apparatus illustrated in FIG. 8 may be configured as a monochromatic image forming apparatus.

The transfer unit 330 according to an embodiment may include a transfer roller 331 that is rotatably supported by a transfer roller holder 333. The transfer roller 331 may be arranged to opposingly face the image carrying body 310 so as to form therebetween a transfer nip N3 through which the printing medium M passes. The transfer roller holder 333 may be detachably received in the main body 300, and may be detachable from the main body 300 in the direction opposite the direction of forming the transfer nip N3.

The transfer unit 330 may further include an elastic member 335 disposed between a frame 301 of the main body 300 and the transfer roller holder 333 that elastically biases the transfer roller 331 in the direction of forming the transfer nip N3. The transfer roller holder 333 and the electrical charge removal unit 340 may have substantially the same configurations as the transfer roller holder 143 and the electrical charge removal unit 150 of the previously described embodiments.

An image forming apparatus according to an aspect of the present disclosure may have, arranged in the main body of thereof, an electrical charge removal unit moveable in association with the mounting and/or detaching movement of one or more components of the transfer unit, e.g., the transfer roller, between a first position at which the charge removal unit is operable to remove electrical charge and a second position allowing the replacement of the component(s) of the transfer unit. Accordingly, it may be possible to position a charge removal electrode at different positions respectively for an optimal charge removal performance during an image forming operation, and for non-interfering with mounting and detachment during a replacement of a component of the transfer unit.

While the disclosure has been particularly shown and described with reference to several embodiments thereof with particular details, it will be apparent to one of ordinary skill in the art that various changes may be made to these embodiments without departing from the principles and spirit of the aspects of the present disclosure, the scope of which is defined in the following claims and their equivalents.

What is claimed is:

1. An image forming apparatus including a main body and an image carrying body disposed in the main body, the image carrying body being configured to support thereon a visible image formed of developer, comprising:

a transfer unit detachably received in the main body, the transfer unit being configured to receive the visible image from the image carrying body and to convey the received visible image to a printing medium; and an electrical charge removal unit rotatably supported in the main body, the electrical charge removal unit being configured to remove an electrical charge from the printing medium, wherein the electricity removing unit being interlocked with mounting or detaching of the transferring unit to move rotatably between an electricity removing position removing an electric charge remaining in the printing medium and an avoiding position not being interfered to the mounting or detaching of the transferring unit.

2. The image forming apparatus according to claim 1, wherein the electrical charge removal unit is configured to move to the avoiding position from the electricity removing position before a completion of mounting or detaching of the transfer unit so as not to interfere with the mounting and detaching of the transfer unit.

3. The image forming apparatus according to claim 2, wherein the transfer unit comprises:

an intermediate transfer unit configured to receive the visible image from the image carrying body;

a transfer roller arranged to form a transfer nip with the intermediate transfer unit, the transfer roller being configured to cause the visible image to be transferred from the intermediate transfer unit to the printing medium passing through the transfer nip; and a transfer roller holder rotatably supporting thereon the transfer roller, the transfer roller holder being receivable into the main body in a first direction forming the transfer nip between the transfer roller and the intermediate transfer unit, and being detachable from the main body in a second direction opposite the first direction.

4. The image forming apparatus according to claim 3, wherein the intermediate transfer unit comprises:

one or more intermediate transfer backup rollers each rotatably supported in the main body;

a transfer belt rotatable to pass between the image carrying body and the one or more intermediate transfer backup rollers to thereby receive the visible image from the image carrying body;

a driving roller configured to drive the transfer belt to rotate; and a transfer backup roller arranged to opposingly face the transfer roller with the transfer belt interposed therebetween.

5. The image forming apparatus according to claim 2, wherein the transfer unit comprises:

a transfer roller arranged to form a transfer nip through which the printing medium passes to receive the visible image from the transfer unit; and a transfer roller holder rotatably supporting thereon the transfer roller, the transfer roller holder being receivable into the main body in a first direction forming the transfer nip, and being detachable from the main body in a second direction opposite the first direction.

6. The image forming apparatus according to claim 5, wherein the transfer unit further comprises an elastic member arranged between the main body and the transfer roller holder in such a manner elastically biasing the transfer roller in the first direction.

7. The image forming apparatus according to claim 5, wherein the electrical charge removal unit comprises:

an electrode holder rotatably supported on the main body;

an electrode supported on the electrode holder, the electrode being configured and arranged to remove the electrical charge from the printing medium after the visible image is at least partially transferred on the printing medium, an electrode support elastic member disposed between the main body and the electrode holder so as to elastically bias the electrode holder in a direction of moving the electrical charge removal unit to the electricity removing position, and a hinge unit rotatably received in a frame of the main body to serve as the rotation center of the electrode holder.

8. The image forming apparatus according to claim 7, wherein an end portion of the electrode being positioned within a path of mounting or detaching movement of the transfer roller when the electrical charge removal unit is in the electricity removing position.

9. The image forming apparatus according to claim 8, further comprising first and second guide members respectively formed on the transfer roller holder and the electrode holder, the first and second guide members being in an interfering contact with each other during mounting or detaching of the transfer roller to guide the electrode to selectively move into and out of the path of mounting or detaching movement of the transfer roller.

10. The image forming apparatus according to claim 9, wherein the first guide member comprises a guide protrusion protruding from the transfer roller holder so as to make an interfering contact with the second guide member when the transfer roller holder is received into or detached from the main body.

11. The image forming apparatus according to claim 10, wherein the second guide member comprises:

a first guide surface configured to guide a rotation of the electrode holder in such a manner to cause the electrode to move from the electricity removing position to the avoiding position when the transfer roller holder is received into the main body, and a second guide surface configured to guide the rotation of the electrode holder to move from the electricity removing position to the avoiding position when the transfer roller holder is detached from the main body.

* * * * *